United States Patent [19]

Abdi et al.

[11] Patent Number: 4,947,103

[45] Date of Patent: Aug. 7, 1990

[54] CURRENT MIRROR HAVE LARGE CURRENT SCALING FACTOR

[75] Inventors: Behrooz Abdi, Chandler; Eric Main; John E. Hanna, both of Mesa, all of Ariz.

[73] Assignee: Motorola, Inc., Schaumburg, Ill.

[21] Appl. No.: 406,493

[22] Filed: Sep. 13, 1989

[51] Int. Cl.[5] ..... G05F 3/26

[52] U.S. Cl. ..... 323/316; 330/288

[58] Field of Search ..... 323/315, 316; 330/288

[56] References Cited

U.S. PATENT DOCUMENTS 4,475,077 10/1984 Nagano ..... 330/288
4,620,161 10/1986 Tanaka et al. ..... 330/288
4,647,870 3/1987 Ishii et al. ..... 323/315

FOREIGN PATENT DOCUMENTS 6906 1/1986 Japan ..... 330/288

*Primary Examiner*—William H. Beha, Jr.
*Attorney, Agent, or Firm*—Michael Bingham

[57] ABSTRACT

A current mirror provides an output current that is scaled in magnitude with respect to an applied input current includes first and second current turnaround circuits and circuitry coupled between the two current turnaround circuits which is responsive to the first current turnaround circuit for sourcing a current to the second current turnaround circuit the magnitude of which is scaled with respect to the input current that is sourced to the first current turn around circuit.

4 Claims, 1 Drawing Sheet

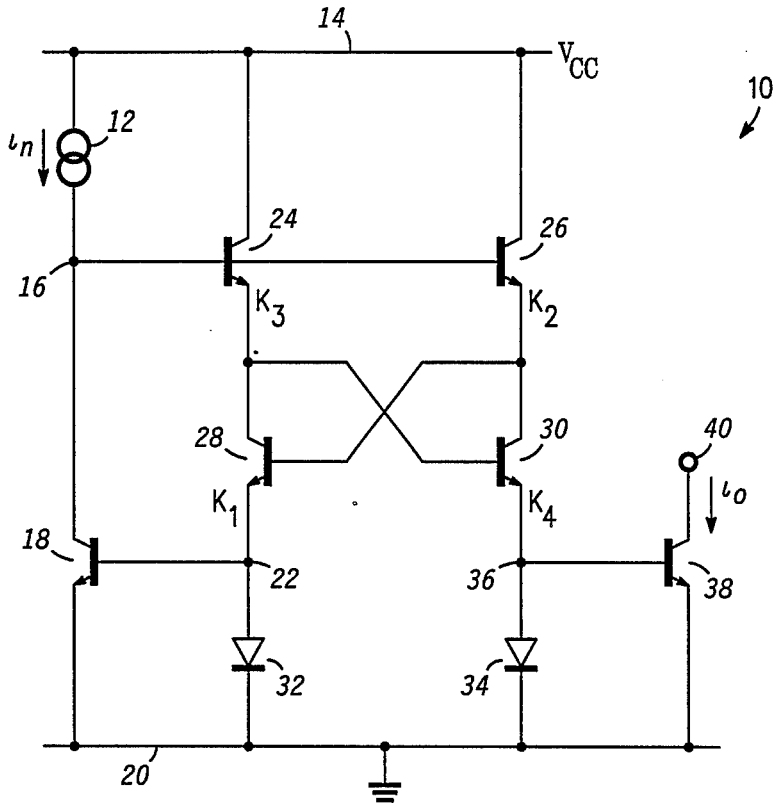
14
$V_{CC}$
10
12
$i_n$
24
26
16
$K_3$
$K_2$
28
30
40
$K_1$
$K_4$
$i_o$
18
22
36
38
32
34
20

CURRENT MIRROR HAVE LARGE CURRENT SCALING FACTOR

BACKGROUND OF THE INVENTION

The present invention relates to current mirrors and, more particularly, to an integrated current mirror for providing a large scale up or scale down factor within a small geometry.

Integrated current mirror circuits are well known in the art. The most common type of integrable current mirror comprises a diode of which the anode is coupled to the base of an output transistor, while the cathode and emitter of the two devices are coupled to ground potential. Typically, the diode is fabricated by shorting the collector and base electrode of a transistor together to the base of the transistor (the anode) while the emitter of the diode connected transistor is returned to ground potential. The collector of the output transistor sinks a current the magnitude of which may be scaled with respect to the magnitude of input current source to the anode of the diode.

If it is desired to scale up the output current flowing through the collector of the output transistor, ie, to have a larger output current than supplied input current, it is typical that the emitter of the output transistor is made N times larger than the emitter of the diode connected transistor. Thus, the output current will be N times the magnitude of the applied input current. Conversely, by making the emitter of the diode connected transistor N times larger than the emitter area of the output transistor, the output current will be N times less than the magnitude of the input current. However, if a large scaling factor, i.e, N greater than 10, is desired, the above described approach is undesirable as a large collector-substrate capacitance results in the larger emitter device. Moreover, the current density of the larger device is reduced which is undesirable in high speed, low current applications.

Another method for scaling the output current with respect to the input current is to place a resistor in series with one of the other of the two transistors. For instances, if the output current is to be scaled down with respect to the input current, a resistor can be added in series with the emitter of the output transistor. The problem with this approach is that although an accurate scaling is achieved at one specified current level, the scaling factor changes with temperature in the applied magnitude of input current which causes undesirable nonlinearities over temperature and is not a good choice for alternating current applications.

Hence, a need exists for an improved current mirror that is suited to be manufactured in integrated circuit form and which provides a large current scaling factor with small geometry.

SUMMARY OF THE INVENTION

Accordingly, it is an object of the present invention to provide an improved current mirror.

It is another object of the present invention to provide a current mirror which can scale up or scale down an output current with respect to an implied input current in minimum geometry.

In accordance with the above and other objects there is provided a current mirror which produces an output current the magnitude of which is scaled with respect to an applied input current. The applied input current is source to a first current turn around circuit for sinking a current at a terminal thereof substantially equal to the input current. A current scaling circuit which is coupled to terminal sources a current to a second current turnaraound circuit the magnitude of which is scaled with respect to the input current wherein the second current turnaround circuit supplies the output current which is substantially of equal magnitude as the current sourced thereto.

The current scaling circuit is comprised of a pair of transistors having their bases cross coupled to the other collector and a pair of additional transistors having their collector-emitter conduction paths coupled respectively to the collectors of the aforementioned pair of transistors while their bases are coupled to the source of input current applied to the current mirror. The feature of the invention is that the emitters areas of the two pairs of transistors are scaled in a predetermined manner with respect to the devices of the current turnaround circuits.

BRIEF DESCRIPTION OF THE DRAWING

The sole FIGURE is a schematic diagram illustrating the current mirror of the preferred embodiment.

DETAILED DESCRIPTION OF THE PREFERRED EMBODIMENT

Referring to the FIGURE, there is shown current mirror 10 of the preferred embodiment. Current mirror 10, as understood, is suited to be manufactured in integrated circuit form and provides an output current the magnitude of which is scaled with respect to an input current. Current mirror 10 is adapted to receive the input current, in, supplied by current source 12, the latter of which is coupled between positive supply conductor 14 and node 16. Transistor 18 has its collector-emitter conduction path coupled between node 16 and power supply conductor 20 to which a negative ground potential is applied while its base is coupled to node 22. Node 16 is also coupled to the base of transistor 24 and 26, the collectors of which are returned to power supply conductor 14. The emitters of transistors 24 and 26 are coupled respectively through the collector-emitter conduction paths of transition 28 and 30 to nodes 22 and 36. The basis of transistor 28 and 30, as shown, are cross coupled to the other's collector. Diode 32 has its anode coupled to node 22 and its cathode coupled to power supply conductor 20. Similarly, diode 34 is coupled between node 36 and power supply conductor 20. The base of output transistor 38 is coupled to node 36 while its emitter is coupled to the power supply conductor 20. The collector transistor 38 is coupled to output terminal 40 and sinks the output current io. Output terminal 40 is adapted to be coupled to a suitable load utilization means (not shown).

As recognized, all transistors are minimum geometry devices except for transistors 24, 26, 28 and 30. Moreover, it is understood that diode 32 and 34 may be realized in an integrated circuit form by having their collector-base shorted together to form the anode whereby the emitter becomes the cathode, and further, that these devices are also minimum geometry transistors. The emitter areas of transistors 24, 26, 28 and 30 are scaled by the factors K3, K2, K1 and K4 with respect to the emitter areas of the minimum geometry devices, where the K factors may be any positive number. For descriptive purposes, the scaled transistors may be referred to as the scaling circuitry. As understood, transistor 18 and diode 32 and transistor 38 and diode 36 comprise conventional first and second current turnaround circuits respectively.

Assuming that all transistors have a large forward current gain, beta, base current drive can be neglected. Since diode 32 is the same size as transistor 18, it is understood that in operation that the former biases the base of the latter such that equal currents flow therethrough. The same occurs with respect to diode 34 and transistor 38 such that current flow in these devices are equal. Hence, because of the above assumption, the current in flows through transistor 18 and is equal to the current flow in diode 32. Likewise, the current flows through diode 34 is equal to the current flowing through the collector-emitter of transistor 38. Thus, by summing the voltage drops across the base-emitters devices, it can be shown that:

$$\phi_{32}+\phi_{28}+\phi_{26}=\phi_{24}+\phi_{30}+\phi_{34} \quad (1)$$

where $\phi$ is the base-emitter voltage: and;

$$i_{32}=i_{28}=i_{24}=i_n:i_{26}=i_{30}=i_{34}.$$

Substituting the above in the known diode-voltage equation gives the following:

$$V_T \ln (i_n/I_s) + V_T \ln (i_n/K_1I_s) + V_T \ln (i_o/K_2I_s) = V_T \ln (i_n/K_3I_s) + V_T \ln (i_o/K_4I_s) + V_T \ln (i_o/I_s). \quad (2)$$

This gives:

$$V_T \ln \frac{i_n^2 i_o}{K_1K_2I_s^3} = V_T \ln \frac{i_n i_o^2}{K_3K_4I_s^3}. \quad (3)$$

or:

$$\frac{i_n^2 i_o}{K_1K_2I_s^3} = \frac{i_n i_o^2}{K_3K_4I_s^3}. \quad (4)$$

Hence:

$$\frac{i_n}{K_1K_2} = \frac{i_o}{K_3K_4}. \quad (5)$$

Thus:

$$\frac{i_o}{i_n} = \frac{K_3K_4}{K_1K_2} = \frac{M}{N} \quad (6)$$

If, for example, io is to be scaled down by a factor of 20, ie, io is 20 times smaller in magnitude than in, K3 and K4 are made equal to one, the same size emitter areas as the minimum geometry devices, while the emitter areas of transistors 28 and 26 are made 4× and 5× larger than the emitter areas of the minimum geometry devices, ie, K1=4 and K2=5. Thus from equation 6:

io=in/20.

Similarly, the scale io up by the factor of 20, this scaling factor would be set to K1=1, K2=1, K3=4, and K4=5.

The advantages of the current mirror of the present invention becomes apparent in view of the forgoing. For typical current mirrors, comprised of a diode coupled across the base-emitter of an output transistor to scale down the input current by a factor 20 would require the diode connected transistor to have an emitter area 20 times the emitter area of the output transistor. The present invention only requires the emitters of transistor 28 and 28 to be 4 and 5 times respective of the minimum geometry devices.

Hence, what has been described above, is a novel current mirror which can be utilized for either scaling the output current up or down with respect to an implied and applied input current wherein for large scaling factors smaller scale transistors can be utilized than for known prior art current mirrors. This allows the nonscale transistors to be minimum geometry which develops less capacitance and higher circuit speed than with other methods known to attain larger scaling factors.

What is claimed is:

1. A current mirror comprising:

first circuit means responsive to an applied input current supplied to a first terminal thereof for providing a current at a second terminal that is substantially equal in magnitude to said input current, said first circuit means including a first transistor having an emitter base and collector being coupled to said first terminal and said base being coupled to said second terminal, and first diode means coupled between said base and said emitter of said first transistor;

second circuit means responsive to a current sourced to a first terminal thereof for providing a current at an output terminal the magnitude of which is substantially equal to the magnitude of said current sourced thereto; and circuit scaling means responsive to said current provided at said second terminal for providing a current that is sourced to said second circuit means the magnitude of which is scaled with respect to said input current, said circuit scaling means including a plurality of transistors the emitter areas of which are scaled with respect to each other with a pair of said plurality of transistors having respective bases being coupled to the collector of the opposite one of said pair of transistors and collector-emitter conduction paths being coupled respectively in series with said first terminals of said first and second circuit means.

2. The current mirror of claim 1 wherein said second circuit means includes:

a second transistor having an emitter, base and collector, said collector being coupled to said output terminal and said base being coupled to said circuit means for receiving said current sourced thereto; and second diode means coupled between said base and emitter of said second transistor.

3. The current mirror of claim 2 wherein;

said first diode means includes a third transistor the base and collector of which are coupled to said base of said first transistor and the emitter of which is coupled to said emitter of said first transistor; and said second diode means includes a fourth transistor the base and collector of which are coupled to said base of said second transistor and the emitter of which is coupled to said emitter of said second transistor, said emitters of said first, second, third and fourth transistors having equal areas.

4. The current mirror of claim 3 wherein said circuit means includes:

said pair of transistors comprising fifth and sixth transistor each having an emitter, base and collector, said bases being cross coupled to said collector of the other, said emitters being coupled respectively to said bases of said first and second transistors and having areas that are scaled by predetermined factors with respect to said emitter areas of said first and second transistors; and seventh and eighth transistor each having a base coupled to said collector of said first transistor and the collector-emitter conduction paths coupled in series respectively to said collectors of said fifth and sixth transistors with the emitter areas of each of said seventh and eighth transistors being scaled by predetermined factors with respect to said emitter areas of said first and second transistors.

* * * * *